United States Patent [19]

Leitch

[11] 4,234,034

[45] Nov. 18, 1980

[54] CONTAINER AND COVER ARRANGEMENT

[75] Inventor: George J. Leitch, Newcastle-upon-Tyne, England

[73] Assignee: MacGregor International S.A., Basel, Switzerland

[21] Appl. No.: 886,400

[22] Filed: Mar. 14, 1978

[51] Int. Cl.[3] ..... E05F 11/06; B63B 19/24

[52] U.S. Cl. ..... 160/193; 114/202; 114/203; 292/256.5

[58] Field of Search ..... 114/201 R, 202, 203; 308/233; 160/188, 193; 105/377, 378; 296/137 B; 292/256.5, 130, 56, 230

[56] References Cited

U.S. PATENT DOCUMENTS

| | | | |
|---|---|---|---|
| 1,763,840 | 6/1930 | Watling | 308/233 |
| 3,952,790 | 4/1976 | Leitch | 160/193 |

FOREIGN PATENT DOCUMENTS

| | | | |
|---|---|---|---|
| 2138583 | 2/1972 | Fed. Rep. of Germany | 114/201 R |

*Primary Examiner*—Sherman D. Basinger
*Attorney, Agent, or Firm*—Emory L. Groff, Jr.

[57] ABSTRACT

A container and cover arrangement such as a ship's hold and hatch cover comprises a plurality of cover elements. Hinges are provided for inter-connecting adjacent ones of the cover elements so as to permit pivotal movement of the cover elements outwardly of the container in response to a pulling force. A latching arrangement is provided which comprises an engagement portion on the container and a latch element displaceably mounted on a cover element for co-operating latching engagement with the engagement portion. The latch element is displaceable in response to said pulling force prior to movement of the cover elements to permit release of engagement between the latch element and engagement portion.

1 Claim, 6 Drawing Figures

CONTAINER AND COVER ARRANGEMENT

BACKGROUND OF THE INVENTION

This invention relates to a cover arrangement for a container. The invention is particularly applicable to hatch covers for ships, but as will be clearly understood, cover arrangements in accordance with the invention may be used in any suitable location or vehicle such as grain storage buildings or railway wagons.

Cover arrangements which employ a plurality of cover elements and which are hinged together and movable together to open a container are known and these are sometimes provided with manual cleating to secure the cover in the closed position. The requirement for manual operation of cleating is a time consuming one and it is particularly advantageous if such cleating can be effected automatically.

SUMMARY OF THE INVENTION

The object of this invention is to provide a cover arrangement which enables automatic latching and release of the cover elements and more particularly but not soley which permits such latching and release of a first cover element.

According to the invention there is provided a container and cover arrangement, the cover comprising a plurality of cover elements, hinge means interconnecting adjacent ones of the cover elements adapted to permit pivotal movement of the cover elements outwardly of the container in response to a pulling force, the improvement comprising latching means comprising an engagement portion on the container and a latch element displaceably mounted on a cover element for co-operating latching engagement with the engagement portion which latch element is displaceable in response to said pulling force prior to said movement of the cover elements to release engagement between the latch element and the engagement portion.

A pulling means responsive to said pulling force may be provided which pulling means is effective to act on the cover elements to open the container. A direction changing means through which the pulling means passes may be provided on the first cover element.

The latching means may be provided on the end of the first cover element opposite to the end which is pivotally connected to the next cover element. The latching means may comprise a plurality of cleats engageable with respective elements on the container and each releasable upon application of said upward pull on the pulling means.

The direction changing means may comprise a pulley. The pulley may be mounted on a pulley support arm. The pulley support arm may be pivotally mounted on the first cover element at a position spaced from the pivotal axis of the pulley so as to permit pivoting of the arm upon application of said pull on the pulling means and the arm may be coupled with the latching means to effect said release. The pivotal mounting of the support arm may be effected by fixedly mounting the arm on a rod such that the pulley is located radially of the rod and mounting the rod in bearings disposed along the first cover element at the end remote from its pivotal connection with the adjacent cover element. In such an arrangement the rod may be provided with a plurality of latching elements fixedly mounted and spaced apart on the rod for cooperation each with a respective element on the container to effect said latching engagement. The arrangement may be such that the weight of the arm is effective to urge the latch into a latching position under the action of gravity and/or may be urged to this position by spring means.

The invention also includes a cover arrangement with fully automatic side and end securement and a ship having a hatch cover comprising a cover arrangement as herein before defined.

BRIEF DESCRIPTION OF THE DRAWINGS

In order that the invention and its various other preferred features may be understood more easily, an embodiment thereof will now be described, by way of example only, with reference to the drawings in which.

DESCRIPTION OF THE PREFERRED EMBODIMENTS

Like numerals identify the same or similar references in the several views.

Figure 1:
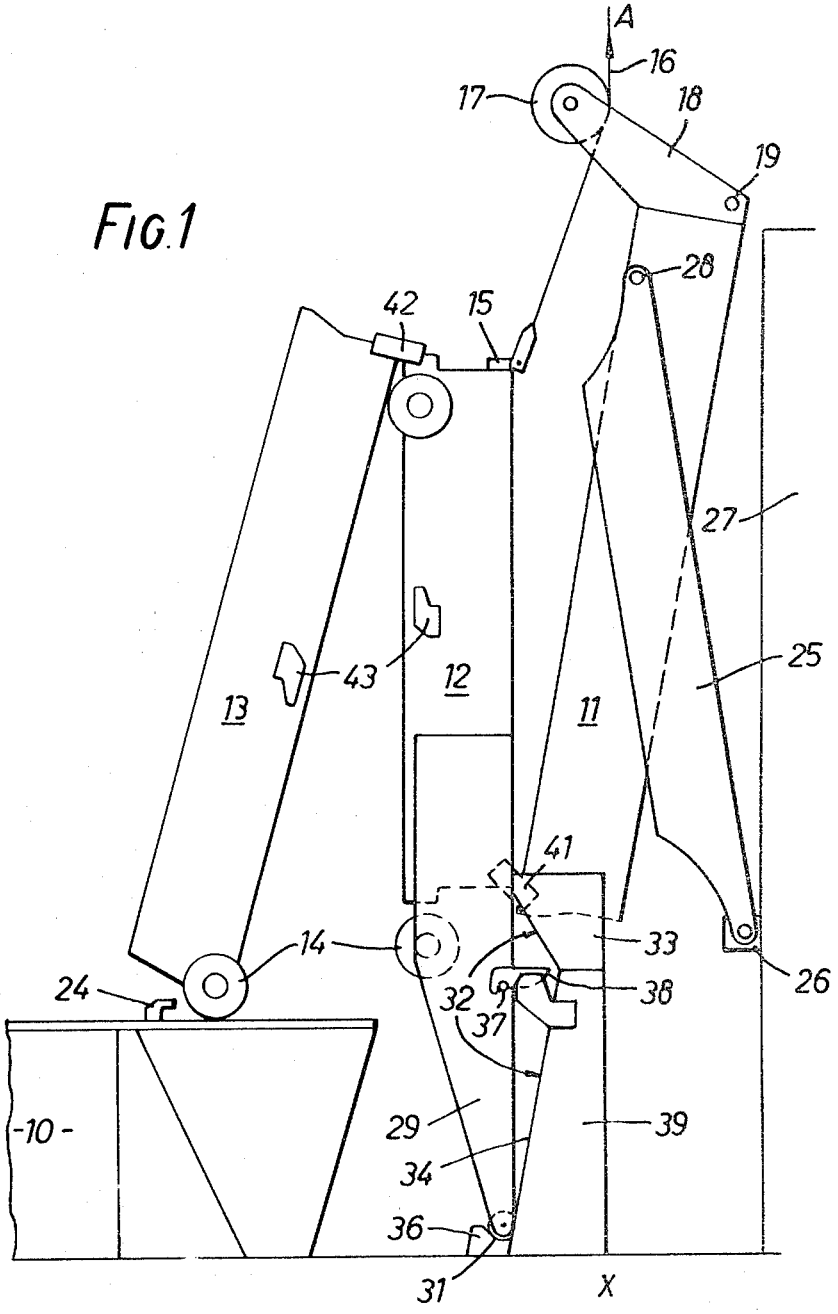
FIG. 1 is a schematic side view of a cover arrangement constructed in accordance with the invention showing the cover in a fully open position.

Referring to FIG. 1 hatch coaming 10 supports three hatch cover elements, henceforth described as panels 11, 12, 13 which are adapted to be movable upon guided wheels 14, flanged or plain, which run on the coaming rest bar at each side, beamwise, of the coaming 10. An attachment point 15 is provided upon one end of panel 12 remote from the stowage end X of the hatchway, and takes one end of a pulling means formed by an operating wire rope or chain 16 which is led in the hatchway opening direction over the top of panel 11 to a direction changing means formed by the pulley 17 which, in the embodiment is mounted upon a pivotable arm 18 which allows the pulley to be stowed below the level of the top of the cover when not in use.

Figure 2:
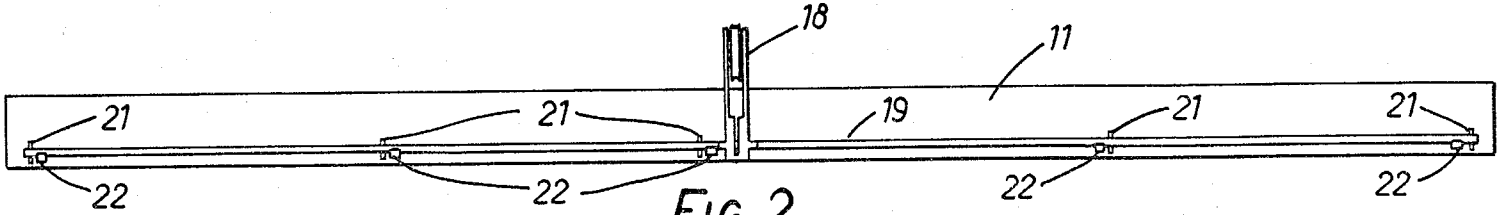
FIG. 2 is an end view of the first hatch section shown at the right hand side in FIG. 1.

The arm 18 is securely fixed to a tubular rod 19 which extends at right angles to each side of the arm at a position remote from the pulley 17 transversely of the end of the panel 11 (see FIG. 2). The rod 19 extends through and is pivotally mounted in brackets 21 which are provided at spaced intervals along the end of the panel 11 and provide for the pivotting of the arm 18. The rod 19 is provided with a plurality of latching elements 22 fixedly secured to the rod and extending radially therefrom. The latch elements are spaced along the rod 19 and are movable therewith and serve for engagement with respective recesses 23 formed in cooperating abutments 24 which are provided on the end coaming of the hatch. This can be seen more easily from FIGS. 3 and 4.

Wire 16 passes around pulley 17 to connect eventually with a derrick winch or crane (not shown) in the direction of arrow A.

A pair of locating arms 25 are pivotably secured at one end 26 to structure 27, which may be any suitable part of the ship's deck furnishings or may be a purpose-built structure: at the other end 28 of the locating arms, they are pivotably secured, one at each side of panel 11.

Panel 12 carries trip levers 29 which extend as part of or as an attachment to each side of this panel, although only one of the levers 29 is shown in FIG. 1. At the leading end (in the direction of opening) of each trip lever is a roller 31 which is so set as to meet one of a pair of guide-ramps 32 when the hatch covers 11, 12 13 have moved to the appropriate stage in the opening movement. The guide ramps 32 are formed by a buffer portion 33 at the upper end and a straight portion 34 at the lower end ending in a roller cup 36 for the roller 31. The trip levers are provided with an automatic latching means comprising projections 37 and co-operating manual/automatic catches 38. The catches 38 are mounted on posts 39 carrying the guide ramps. This is so arranged that, on opening of the hatch cover, the projections 37 automatically engage in the catch 38. Release of the catch 38 is then carried out by hand when it is desired to close the hatch cover. The posts 39 are suitably fixed adjacent to the coaming 10.

Panels 11, 12, 13 are connected to one another by means of hinges 41, 42. As can be seen, the hinge 41 connects the panels 11 and 12 at their upper adjacent edges and the hinge 42 connects the panels 12 and 13 at their lower adjacent edges. During opening and closing operations, hinge 41 pulls and pushes panels 12 and 13, supports panel 11, and controls the stowed attitude of panels 11 and 12. In the closed hatch condition it is flush with the top of the panels.

Figure 3:
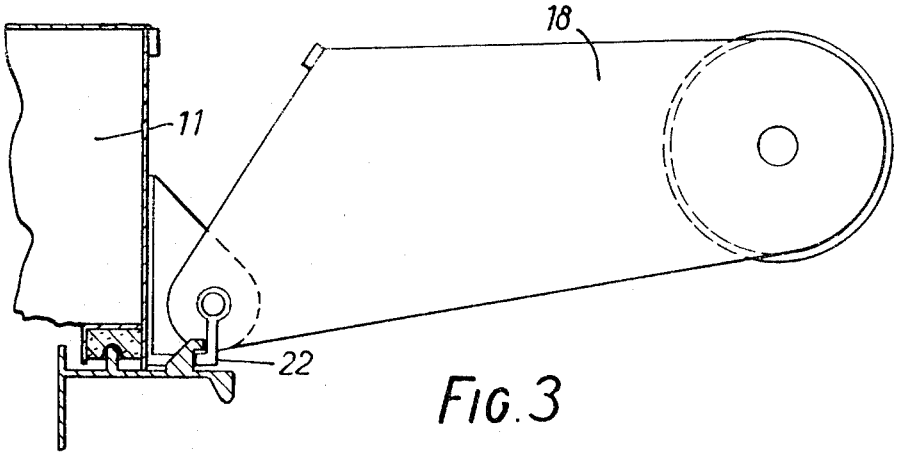
FIG. 3 is a schematic illustration to an enlarged scale showing a detail of FIG. 1 and illustrating an end cleating arrangement in the engaged position.
Figure 4:
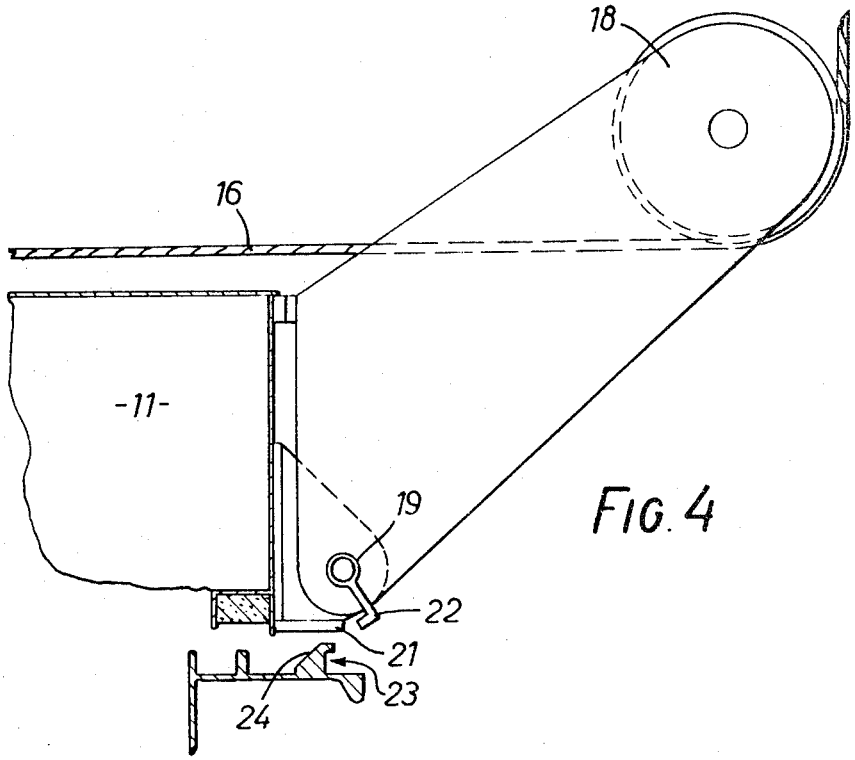
FIG. 4 is a schematic illustration similar to FIG. 3 showing the end cleating arrangement in the released position.

In the closed position of the hatch cover the arm 18 is pivoted in the clockwise direction, as viewed in FIG. 3, under the action of gravity and in the absence of a pulling force on the pulling means 16, and the latching elements 22 automatically engage the recesses 23 to secure the end of the panel 11.

Figure 5:
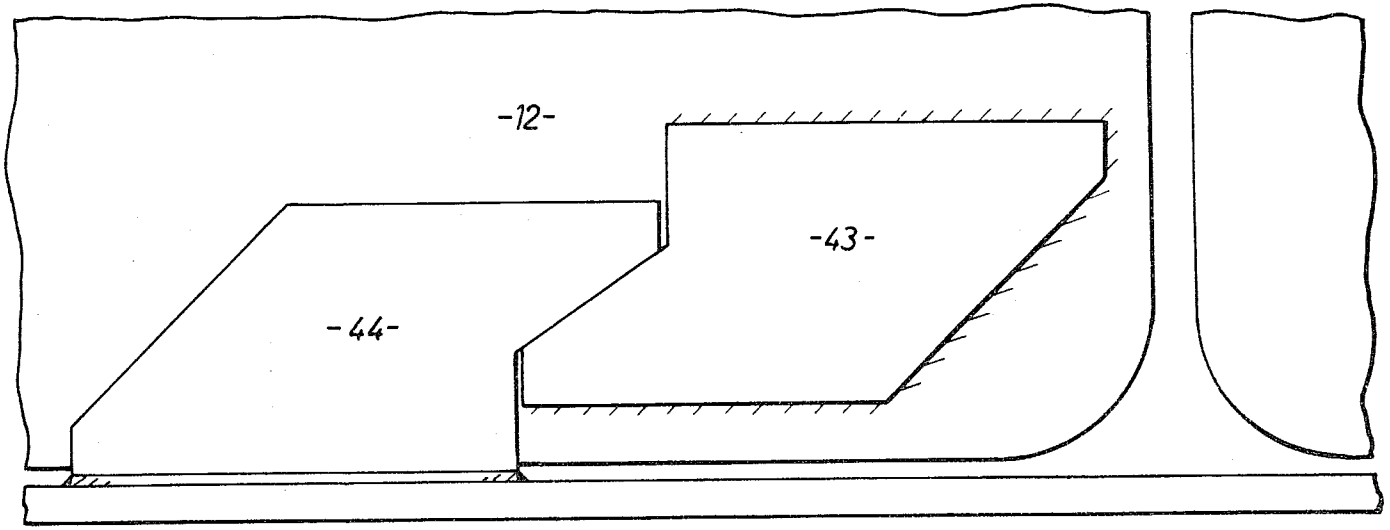
FIG. 5 is a schematic side view illustrating automatic side cleating of the cover elements shown in FIG. 1.

The panels are also provided with side cleating in the form of wedges 43 which cooperate with wedging recesses formed in abutments 44 provided along the coaming to the side of the hatch opening such that automatic sliding engagement of the wedges with the recess occurs as the panels are moved into the closed position (see FIG. 5).

Figure 6:
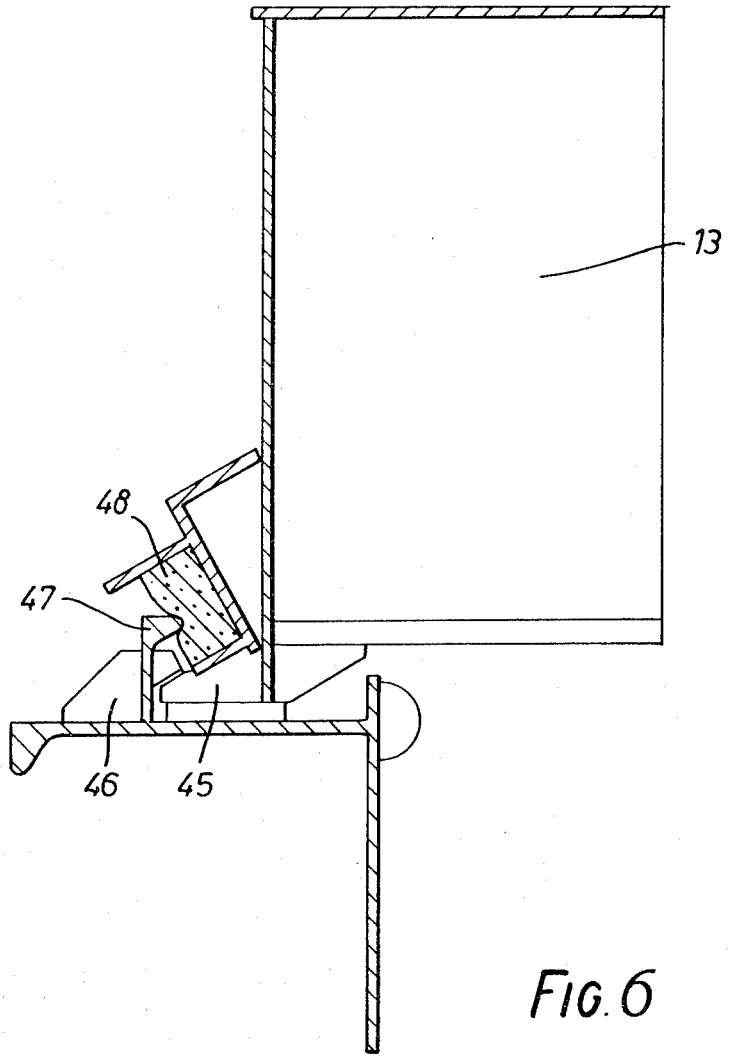
FIG. 6 is a schematic side view illustrating automatic end cleating of the third cover element shown to the left in FIG. 1.

The end panel 13 is also provided with end cleating as can be seen in FIG. 6. This comprises a wedge 45 which extends along the end of the panel 13 opposite to the hinge 42 and cooperates with a wedging recess formed in an abutment 46 on the end coaming. As the panels are moved into the closed position the wedge 45 is moved into engagement with the recess in the abutment 46 to automatically cleat the end of the panel 13. The end coaming is provided with a sealing strip 47 which engages a resilient seal 48 carried by the panel 13.

In operation, the opening procedure is as follows: the operating wire, rope or chain 16 is rigged as described above, and any manual hatch cover locks and the like are released. A pull is exerted upon the operating wire, rope or chain 16, and this pull causes the arm 18 to pivot in the anti-clockwise direction as viewed in the drawings so as to release the latches and to permit panel 11 to pivot upwardly about pivot-point 41 (which is a hinge) pulling behind it panels 12 and 13 which move upon wheels 14, this action releases the wedges 43 and 45 from the wedging recesses and also releases any seals or automatic locks that are provided. At the same time locating arms 25 control the movement of panel 11 by their attachment at points 26, 28.

As the appropriate stage of opening is reached, during raising of the panel 11 towards the vertical, the rollers 31 on trip levers 29 contact guide-ramps 32 and are guided thereby in a downward direction, i.e. towards deck-level whilst panel 12 rotates in a clockwise arc (relative to the drawings) initially about the moving wheels 14 assisted by the pulling action of the wire, rope or chain 16. The rearmost end of panel 12 carries with it the leading end of panel 13, the rearmost end of which, in turn, rests upon its wheels 14. When the roller 31 on each trip lever 29 engages with a respective cup 36 at the base of posts 39 this then becomes the fulcrum point and the wheels 14 lift off the coaming top.

The pull upon operating wire, rope or chain 16 is maintained until the three panels have completely cleared the hatchway opening, at which stage automatic latches 38 are engaged on projections 37 on trip lever 29 holding the panels in their "open" disposition.

No further apparatus is required to close the panels. After manually releasing the latches 38, the operating wire 16 is merely paid out with the panels' own weight carrying them back to their starting, or "closed" positions with the wedges 43 and 45 engaging their respective wedging recesses on the coaming. This movement is however, advantageously assisted by the centre of gravity of panel 12 being to the left of the axis of roller 31 to permit a toppling movement to occur when the support of the operating wire is removed.

The closing movement is further assisted by the action of trip levers 29 having rotated panel 11 from its fully stowed position such that the weight of panel 11 now becomes a driving force assisting to fully close the hatchway.

The release of tension on the operating wire then enables the arm 18 to pivot in a clockwise direction as viewed in the drawings so that the latching elements 22 are pivoted under the action of gravity into engagement with the recesses 23 on the abutments 24 thereby cleating the end of the panel 11. It will be appreciated that this results in automatic cleating of both sides of each panel and the remote ends of each end panel.

The guide-ramps 32 are suitable buffered by the buffer portion 33 so that they may accommodate the shock of being struck by the wheels 31 trip levers 29 during movement of the panels. They may therefore include hydraulic shock-absorbers of known type, or may be faced at the contact point with a resilient material e.g. rubber. The said material may be in hollow cushion-like formation or may be of bag-like construction filled with a suitable fluid e.g. water or with a foamed plastics material. These buffers may be arranged to be compressed by the trip lever 29 when the panels are fully stowed and therefore further assist the initial closing movement.

By the use of an arrangement of hatchcovers constructed as above described, a normal ship's derrick or crane or a winch may be used for the opening and closing procedure and that fully automatic cleating can be effected. The only manual operations necessary in the opening and closing of the cover is the attachment of the crane and the release of the catch 38 which is a safety feature which could be arranged to be released by any suitable remotely controllable means.

The simple rigging arrangement employed (i.e. without pullies specially fitted upon the ship structure) ensures that, for any specific set of hatch covers of this type, the relationship between effort and wire movement required can be optimised.

For still more stowage area, the locating arms 25 may be formed by a further panel covering at least part of the area between them, and forming a surface capable of supporting cargo, e.g. containers of conventional type.

The geometry of this system, i.e. the relationship of hinge and pivot centres, is arranged to ensure that movement of any part of the cover structure or fittings, when opening, does not take place away from the direction of stowage, beyond their position when at rest in the hatch closed condition, thus ensuring any sealing gaskets are not compressed beyond the designed characteristics when the covers are in the final closed position.

Furthermore, the closing movement may incorporate a specific action allowing the sealing and locking of the transverse joints between panels 11 and 12, 12 and 13, longitudinal sides of panels 12 and 13, and the end of panel 13 remote from stowage, to be fully automatic.

Any suitable locking arrangement may be employed to lock and/or weather-seal the panels when they are in the closed position, both to themselves and to the coaming of the hatchway. One such suitable arrangement for side and end cleating which may be employed in place of the wedges 43 and 45 is that sold under the Trade Mark "ROLLTITE" by the present Applicants.

Although the invention has been described as an arrangement of three panels, the operation of it remains virtually identical for an arrangement of only two panels. For arrangements of more e.g. four, five or more panels, similar operation can be achieved with suitable modifications. Such modifications may include suitable positioning of the attachment point for the operating wire and/or suitable constructional arrangements. For example, it may be convenient to position the attachment point upon the free end of an extension arm pivotably secured to the penultimate panel in the line as they move towards opening.

To assist the closing action, there may, if desired, be provided a compression spring, ram or the like at a point where it will be contacted and compressed by one or more of the panels when the latter is in the stowed (hatchway open) position, and urge the panel(s) towards the closed position. Conveniently, the spring or ram (which may be power-operated or released) is fixed upon the support structure 27 where it can be compressed by panel 11 or by part of the locating arms 25, or a panel (hingedly connected at at least one end to panel 11) which may replace the latter.

Although the hatch cover system described above is based on the use of normal ships derricks or cranes, if such equipment is not available, suitable arrangements can be incorporated to provide rigging from alternative sources, e.g. mooring winches, shore cranes etc.

The present invention although described and illustrated for a weather-deck cover can readily be applied to flush tween-deck covers with suitable modifications.

As previously mentioned, while the cover arrangement has been described as particularly applicable to ships hatches, it can nevertheless be used in other locations such as on railway wagons or grain storage buildings.

It will be understood that the above description of the present invention is susceptible to various modification changes and adaptations.

What is claimed is:

1. A container and cover arrangement, the cover comprising a plurality of cover elements, hinge means interconnecting adjacent ones of the cover elements adapted to permit pivotal movement of the cover elements outwardly of the container in response to a pulling force, the improvement comprising latching means comprising an engagement portion on the container and a latch element displaceably mounted on a cover element for co-operating latching engagement with the engagement portion, which latch element is displaceable in response to said pulling force prior to said movement of the cover elements to release engagement between the latch element and the engagement portion, pulling means coupled with said cover elements and communicating said pulling force to said cover elements to open the container, direction changing means comprising a pulley mounted on the first cover element through which said pulling means passes, a pulley support arm mounted on said first cover element and carrying said pulley, a pivotal mounting for said pulley support arm on the first cover element at a position spaced from the pivotal axis of said pulley so as to permit pivoting of the arm upon application of a pull on said pulling means, wherein the pivotal mounting of said pulley support arm is arranged such that the weight of the arm and pulley is effective to urge the latching means into a latching position under the action of gravity.

* * * * *